US005360536A

United States Patent [19]

Nemeth et al.

[11] Patent Number: 5,360,536

[45] Date of Patent: Nov. 1, 1994

[54] REMOVAL OF SULFUR COMPOUNDS FROM LIQUID ORGANIC FEEDSTREAMS

[75] Inventors: Laszlo T. Nemeth, Palatine; Santi Kulprathipanja, Inverness; Blaise J. Arena, Chicago; Jennifer S. Holmgren, Bloomingdale, all of Ill.

[73] Assignee: UOP, Des Plaines, Ill.

[21] Appl. No.: 103,388

[22] Filed: Aug. 9, 1993

[51] Int. Cl.[5] ..... C10G 29/16

[52] U.S. Cl. ..... 208/248; 208/226; 208/243; 208/244; 208/246

[58] Field of Search ..... 208/244, 243, 226, 230, 208/246, 247, 248, 250

[56] References Cited

U.S. PATENT DOCUMENTS

| | | | |
|---|---|---|---|
| 3,442,797 | 5/1969 | Aldridge | 208/248 |
| 4,571,445 | 2/1986 | Slaugh | 208/226 |
| 4,866,019 | 9/1989 | Van Broekhoven | 502/68 |
| 4,889,615 | 12/1989 | Chin et al. | 208/120 |
| 4,935,146 | 6/1990 | O'Neill et al. | 210/684 |
| 5,114,898 | 5/1992 | Pinnavaia et al. | 502/406 |
| 5,157,201 | 10/1992 | Norris | 208/244 |

OTHER PUBLICATIONS

"Hydrotalcite Catalysis of Hydrotreating Reactions", Sharma et al, American Chemical Society, Div. of Fuel Chem., vol. 36, No. 2, pp. 570–577, Apr. 14–19, 1991.

*Primary Examiner*—Paul Lieberman
*Assistant Examiner*—Lorna M. Douyon
*Attorney, Agent, or Firm*—Thomas K. McBride; Eugene I. Snyder; Frank S. Molinaro

[57] ABSTRACT

A process for removing sulfur containing compounds from various liquid organic feedstreams has been developed. The process involves contacting the feed stream with a metal oxide solid solution which adsorbs the sulfur containing compounds. Examples of these solid solutions are Mg/Al and Ni/Mg/Al oxide solid solutions.

10 Claims, No Drawings

REMOVAL OF SULFUR COMPOUNDS FROM LIQUID ORGANIC FEEDSTREAMS

FIELD OF THE INVENTION

This invention relates to a process for removing sulfur containing compounds from various liquid organic feedstreams. The process involves contacting the feed stream with a metal oxide solid solution which adsorbs the sulfur containing compounds.

BACKGROUND OF THE INVENTION

Sulfur and sulfur containing compounds, e.g., $H_2S$, mercaptans, organic sulfides and disulfides, etc. are present in crude oil and remain to various degrees in the products obtained from the refining of these crude oils. For example, kerosine and gasoline can contain appreciable amounts of mercaptans which give these products an objectionable odor. One common way to make these products less malodorous is to convert the mercaptans to disulfides. This is known as sweetening. Although sweetening eliminates the mercaptans, it does not remove the sulfur compounds. As stricter pollution control regulations are passed, it is becoming necessary to actually remove the sulfur compounds and not just convert them to less malodorous compounds.

Sulfuric acid or sulfur dioxide is also used as a catalyst in various hydrocarbon conversion processes. However, in some cases sulfur compounds are formed as byproducts. For example, in the oxidative conversion of cumene to phenol and acetone, alphamethylstyrene is produced as a byproduct along with sulfur compounds such as ethyl mercaptan, dimethyl sulfide, diethyl disulfide and carbon disulfide. Sulfur free alphamethylstyrene is a saleable product and thus it is important to remove all the sulfur compounds from the alpha-methylstyrene. One way to remove these sulfur compounds is to use a nickel/clay mixture. However, this also polymerizes the alpha-methylstyrene to poly alpha-methylstyrene. Therefore, there is a need for a process to remove these sulfur compounds without polymerizing the alpha-methylstyrene.

Applicants have developed a process which removes the sulfur compounds without polymerizing the alpha-methylstyrene. This process involves contacting the alphamethylstyrene with an adsorbent which is a solid solution of metal oxides. The solid solution has the formula $M_a(II)M_b(III)O_{(a+b)}(OH)_b$ where M(II) is at least one metal having a +2 oxidation state, selected from the group consisting of magnesium, nickel, zinc, copper, iron, cobalt, calcium and mixtures thereof and M(III) is at least one metal having a +3 oxidation state and is selected from the group consisting of aluminum, chromium, gallium, scandium, iron, lanthanum, cerium, yttrium, boron and mixtures thereof and the ratio of a:b is greater than 1 to about 15. A preferred solid solution is a nickel oxide/magnesium oxide/aluminum oxide solid solution. The solid solution adsorbs the sulfur compounds without polymerizing the alpha-methylstyrene.

These metal oxide solid solutions are also capable of removing mercaptans from kerosine or hydrogen sulfide from hydrocarbon streams such as toluene. In both of these cases, the sulfur compounds are removed without affecting the desired product, i.e., no reaction takes place between the solid solution (adsorbent) and the feedstream.

The prior art has concerned itself with removing sulfur compounds from gas mixtures. For example, U.S. Pat. No. 5,114,898 discloses that layered double hydroxides (LDH) having the formula $$(M_{1-x}^{II}M_x^{III}(OH)_2)(A^{n-})_{x/n}\cdot pH_2O$$

where $M^{II}$ is a divalent metal cation, $M^{III}$ is a trivalent metal cation and A is an interlayer anion of charge n−. The process involves contacting the flue gas with the LDH at temperatures of 500° to 1000° C., in order to adsorb the $SO_x$ onto the LDH. It should be pointed out that LDHs are precursors of solid solutions. That is, a solid solution is usually prepared from an LDH by heating the LDH at a temperature of about 300° to about 700° C.

In contrast, applicants use a solid solution of metal oxides to adsorb sulfur compounds from a liquid organic feedstream. The contacting is carried out at room temperature or slightly above room temperature. There is no hint in the '898 reference that a solid solution derived from an LDH could adsorb sulfur compounds from a liquid organic feedstream. Thus, applicants are the first to have developed such a process.

SUMMARY OF THE INVENTION

As stated, this invention relates to a process for removing sulfur compounds from a liquid organic feedstream. The process involves contacting the feedstream with an adsorbent at a temperature of about −20° C. to about 200° C. for a time sufficient to adsorb said sulfur containing compounds onto said adsorbent, the adsorbent characterized in that it is a solid solution having the formula $M_a(II)M_b(III)O_{(a+b)}(OH)_b$ where M(II) is at least one metal having a +2 oxidation state and is selected from the group consisting of magnesium, nickel, zinc, copper, iron, cobalt, calcium and mixtures thereof and M(III) is at least one metal having a +3 oxidation state and is selected from the group consisting of aluminum, chromium, gallium, scandium, iron, lanthanum, cerium, yttrium, boron and mixtures thereof and the ratio of a:b is greater than 1 to about 15. A preferred solid solution is nickel oxide, magnesium oxide and aluminum oxide.

Other objects and embodiments of this invention will become apparent in the following detailed description.

DETAILED DESCRIPTION OF THE INVENTION

One essential feature of the instant invention is an adsorbent which is capable of adsorbing sulfur containing compounds such as mercaptans from a liquid organic feedstream without affecting the feedstream. As defined in this specification and for the appended claims, adsorption means both chemisorption and physisorption. The adsorbents which can be employed in the invention are those compounds characterized as solid solutions of metal oxides and which have the formula $M_a(II)M_b(III)O_{(a+b)}(OH)_b$ where M(II) is a metal with a +2 oxidation state and M(III) is a metal with a +3 oxidation state. The M(II) metals are selected from the group consisting of magnesium, nickel, zinc, copper, iron, cobalt and mixtures thereof, while M(III) is selected from the group consisting of aluminum, chromium, gallium, scandium, iron, lanthanum, cerium, yttrium, boron, and mixtures thereof. Finally, a and b are chosen such that the ratio of a:b is greater than one to about 15. When the M(II) metal is a mixture of two metals, the relative amount of each metal can range from 1 to 99 weight percent of the M(II) metal. That is, if M1 and M2 represent the two metals making up M(II), then M1 and M2 can vary from 1 to 99 weight percent of the amount of M(II) in the composition. Preferred solid solutions are Mg/Al oxides and Ni/Mg/Al oxides solid solutions.

Generally these solid solutions are prepared from the corresponding layered double hydroxide (LDH) by heating the LDH at a temperature of about 300° to about 750° C. The LDH materials are basic materials that have the formula $$M_a(II)M_b(III)(OH)_{2a+2b}(X^{-n})_{b/n}.zH_2O$$

The M(II) and M(III) metals are the same as those described for the solid solution. The values of a and b are also as set forth above. X is an anion selected from the group consisting of carbonate, nitrate and mixtures thereof, where n is the charge on the anion. Finally, z varies from about 1 to about 50 and preferably from about 1 to about 15. These materials are referred to as layered double hydroxides because they are composed of octahedral layers, i.e., the metal cations are octahedrally surrounded by hydroxyl groups. These octahedra share edges to form infinite sheets. Interstitial anions such as carbonate are present to balance the positive charge in the octahedral layers.

The preparation of layered double hydroxides is well known in the art and can be exemplified by the preparation of a magnesium/aluminum layered double hydroxide which is known as hydrotalcite. Hydrotalcite can be prepared by coprecipitation of magnesium and aluminum carbonates at a high pH. Thus magnesium nitrate and aluminum nitrate (in the desired ratios) are added to an aqueous solution containing sodium hydroxide and sodium carbonate. The resultant slurry is heated at about 65° C. to crystallize the hydrotalcite and then the powder is isolated and dried. Extensive details for the preparation of various LDH materials may be found in *J. Catalysis,* 94, 547–557 (1985) which is incorporated by reference.

The feedstreams which can be treated using the instant process are any liquid organic feedstreams which contain sulfur compounds. Examples of these feedstreams include but are not limited to kerosine, gasoline, polymerizable compound streams and diesel oil. Polymerizable streams include alpha-methylstyrene, styrene, butadiene and ethylene.

The sulfur compounds which can be adsorbed by the metal oxide solid solution include but are not limited to hydrogen sulfide, carbon disulfide, ethyl mercaptan, dimethylsulfide, diethyl disulfide, methyl mercaptan, sulfur dioxide and thiophene.

The process involves contacting the liquid organic feedstream with the solid solution adsorbent using means well known in the art. For example, the contacting can be carried out in a batch mode or in a continuous mode. In order to ensure that the sulfur compounds are completely adsorbed onto the solid solution, it is necessary that the feedstream be contacted with the solid solution for a time from about 1 to about 60 min. If the process is carried out in a continuous manner, these contact times correspond to a liquid hourly space velocity of about 0.1 to about 10 $hr^{-1}$.

The contacting can be carried out over a broad temperature range. Generally the temperature range is from about −20° C. to about 200° C. with a range of 20° C. to 60° C. being preferred. Finally, the pressure is atmospheric pressure.

Whether the process is carried out in a batch or continuous manner, the adsorbent can be used in the form of extrudates, pills, spheres, etc. The adsorbent can be formed into the desired form or shape at various steps in the process used to prepare the metal oxide solid solution. Thus, the LDH can be formed into the desired shape either immediately after it has been crystallized or after the crystalline gel has been dried into a powder. Either the gel or the dry powder can be formed into the desired shape by extruding, marumerizing or other techniques well known in the art. These shaped particles are then calcined at a temperature of about 300° to about 750° C. to convert the LDH into the corresponding solid solution. Alternatively, the LDH can be converted into the solid solution and then formed into the desired shape.

The following examples are presented in illustration of this invention and are not intended as undue limitations on the generally broad scope of the invention as set out in the appended claims.

EXAMPLE 1

$MgO/Al_2O_3$ Solid Solution

A 2 L, 3-necked round bottomed flask was equipped with a reflux condenser, a thermometer, and a mechanical stirrer. To this flask there was added a solution containing 610 g of water, 60 g of $Na_2CO_3.H_2O$ and 71 g of NaOH and the flask was cooled to <5° C. An addition funnel containing 345 g water, 130 g of $Mg(NO_3)_2.6H_2O$ and 75 g $Al(NO_2)_3.9H_2O$ was put in place of the reflux condensor and the solution added to the solution in the flask over a four (4) hour period while maintaining the temperature at <5° C. The resultant slurry was stirred for 1 hour at <5° C. after which the funnel was removed and the reflux condenser replaced. The flask was now placed in a Glass Col® heating mantle and was heated to 60° C.±5° for 1 hour. The slurry was then cooled to room temperature, the solids recovered by filtration and washed with 10 L of deionized water. These solids were then dried at 100° C. for 16 hours. Analysis of this solid by x-ray showed it to be hydrotalcite. After crushing the solid was calcined at 450° C. for 12 hours in a muffle furnace with air flow. This product was characterized as a magnesium-aluminum solid solution by x-ray diffraction and was found to have a surface area of 285 $m^2/g$ by the B.E.T. technique. This product was identified as sample A.

EXAMPLE 2

$NiO/MgO/Al_2O_3$ Solid Solution

The procedure detailed in Example 1 was followed to prepare a $NiO/MgO/Al_2O_3$ solid solution with the following modifications. The solution that was added to the 3-neck flask was composed of 585 g of water, 60 g $Na_2CO_3.H_2O$ and 71 g of NaOH. The addition funnel contained 375 g of water, 6.5 g $Mg(NO_3)_2.6H_2O$, 139 g $Ni(NO_3)_2.6H_2O$ and 93 g $Al(NO_3)_3.9H_2O$. The calcined product was analyzed and found to contain (by weight) 60.11% Ni, 1.35% Mg, 14.50% Al and 0.69% Na. X-ray diffraction analysis showed this product to be a solid solution of nickel, magnesium and aluminum oxides. Finally this sample had a B.E.T. surface area of 205 $m^2/g$ and identified as sample B.

EXAMPLE 3

$NiO/MgO/Al_2O_3$ Solid Solution

The procedure detailed in Example 1 was followed to prepare a $NiO/MgO/Al_2O_3$ solid solution with the following modifications. The solution that was added to the 3-neck flask was composed of 585 g of water, 60 g $Na_2CO_3.H_2O$ and 71 g of NaOH. The addition funnel contained 378 g of water, 32.5 g $Mg(NO_3)_2.6H_2O$, 110 g $Ni(NO_3)_2.6H_2O$ and 93 g $Al(NO_3)_3.9H_2O$. The calcined product was analyzed and found to contain (by weight): 47.19% Ni, 6.91% Mg, 14.22% Al and 0.96% Na. X-ray diffraction analysis showed this product to be a solid solution of nickel, magnesium and aluminum oxides. Finally, this sample had a B.E.T. surface area of 199 $m^2/g$.

EXAMPLE 4

A portion of sample B was packed into a 72 ml helical column which was maintained at 30° C. A feedstock of 1,300 ml alpha-methylstyrene containing 23 ppm sulfur as ethylmercaptan, 23 ppm sulfur as dimethylsulfide, 58 ppm sulfur as carbon disulfide and 30 ppm of sulfur as diethyldisulfide was flowed through the column under nitrogen at a liquid hourly space velocity of 1 $hr^{-1}$. After this feedstock was flowed through, a second feedstock of 350 ml of alpha-methylstyrene containing 1,900 ppm S as ethylmercaptan, 22 ppm S as dimethylsulfide, 3,600 ppm S as carbon disulfide and 33 ppm S of diethyldisulfide was flowed through the column at the same rate. Periodically samples were obtained for sulfur analysis by gas chromatography equipped with an atomic emission detector. The concentration of the various sulfur compounds in the product stream after various amounts of feedstock were passed over the adsorbent are presented in Table A.

TABLE A

| | Product Stream Sulfur Compound Conc. | | | |
|---|---|---|---|---|
| Feed Vol. (ml) | $C_2H_5SH$ (ppm S) | $(CH_3)_2S$ (ppm S) | $(C_2H_5)_2S_2$ (ppm S) | $CS_2$ (ppm S) |
| 260 | 0 | 11 | 14 | 0 |
| 504 | 0 | 14 | 24 | 0 |
| 743 | 0 | 14 | 21 | 0 |
| 1300 | 0 | 17 | 21 | 0 |
| 1372* | 0 | 1.7 | 0 | 3 |
| 1444* | 0 | 5.5 | 498 | 1462 |
| 1504* | 0 | 24 | 736 | 1790 |
| 1636* | 460 | 39 | 938 | 2909 |
| 1660* | 1000 | 40 | 960 | 3637 |

*Second feedstock flowed through adsorbent.

From these analyses, the adsorption capacity was calculated to be 564.7 mg for ethylmercaptan, 623 mg for carbon disulfide, 4.4 mg for dimethylsulfide and 4.6 mg for diethyldisulfide.

EXAMPLE 5

A sample of sample A was tested to see how it adsorbed $H_2S$ from a toluene feed as follows. In a container 2000 ml of toluene containing 157 ppm $H_2S$ was added to 20 g of sample A. Analyses were conducted periodically to determine the amount of $H_2S$ remaining in the toluene. These results are presented in Table B.

TABLE B

| Time (hrs) | $H_2S$ (ppm) |
|---|---|
| 0 | 157 |
| 1 | 119 |
| 2 | 83 |
| 4 | 33 |
| 5 | 11 |
| 10 | 2 |

From this data it was calculated that the adsorption capacity of sample A for $H_2S$ was 1.34 weight percent.

EXAMPLE 6

To a container containing 20 g of sample C there were added 2000 ml of toluene containing 157 ppm $H_2S$. Analyses were conducted periodically to determine the amount of $H_2S$ remaining in the toluene. The results are presented in Table C.

TABLE C

| $H_2S$ Adsorption for $NiO/MgO/Al_2O_3$ | |
|---|---|
| Time (hrs) | $H_2S$ (ppm) |
| 0 | 157 |
| 1 | 101 |
| 2 | 51 |
| 4 | 10 |
| 5 | 3 |
| 10 | 2 |

Analysis (by XRD) of the spent Ni/Mg/Al solid solution adsorbent showed the presence of nickel sulfide indicating that the hydrogen sulfide had been chemisorbed onto the solid solution and not just physisorbed.

We claim as our invention:

1. A process for removing sulfur containing compounds from a liquid organic feedstream comprising contacting the feedstream with an adsorbent at a temperature of about −20° C. to about 200° C. for a time sufficient to adsorb said sulfur containing compounds onto said adsorbent, the adsorbent characterized in that it is a solid solution of metal oxides having the formula $M_a(II)M_b(III)O_{(a+b)}(OH)_b$ where M(II) is at least one metal having a +2 oxidation state and is selected from the group consisting of magnesium, nickel, zinc, copper, iron, cobalt, calcium and mixtures thereof and M(III) is at least one metal having a +3 oxidation state and is selected from the group consisting of aluminum, chromium, gallium, scandium, iron, lanthanum, cerium, yttrium, boron and mixtures thereof and the ratio of a:b is greater than 1 to about 15.

2. The process of claim 1 where the process is carried out in a continuous mode.

3. The process of claim 2 where the feedstream is contacted with the adsorbent at a liquid hourly space velocity of about 0.1 to about 10 $hr^{-1}$.

4. The process of claim 1 where the process is carried out in a batch mode.

5. The process of claim 4 where the feedstream is contacted with the adsorbent for a time from about 1 to about 60 minutes.

6. The process of claim 1 where the solid solution is a magnesium oxide and aluminum oxide solid solution.

7. The process of claim 1 where the solid solution is a nickel, magnesium and aluminum oxides solid solution.

8. The process of claim 1 where the feedstream is selected from the group consisting of kerosine, gasoline, alpha-methylstyrene, styrene, butadiene, ethylene and diesel oil.

9. The process of claim 8 where the feedstream is alpha-methylstyrene.

10. The process of claim 1 where the sulfur containing compound present in the feedstream is at least one compound selected from the group consisting of hydrogen sulfide, carbon disulfide, ethyl mercaptan, dimethylsulfide, diethyl disulfide, methyl mercaptan, sulfur dioxide and thiophene.

* * * * *